US010741158B1

(12) United States Patent
Aune

(10) Patent No.: US 10,741,158 B1
(45) Date of Patent: Aug. 11, 2020

(54) REDUCED-NOISE HYDRAULIC FRACTURING SYSTEM

(71) Applicant: Liberty Oilfield Services LLC, Denver, CO (US)

(72) Inventor: Roy Aune, Golden, CO (US)

(73) Assignee: Liberty Oilfield Services LLC, Denver, CO (US)

( * ) Notice: Subject to any disclaimer, the term of this patent is extended or adjusted under 35 U.S.C. 154(b) by 338 days.

(21) Appl. No.: 15/669,524

(22) Filed: Aug. 4, 2017

Related U.S. Application Data

(60) Provisional application No. 62/371,678, filed on Aug. 5, 2016.

(51) Int. Cl.

| | |
|---|---|
| ***G10K 11/168*** | (2006.01) |
| ***E04B 1/84*** | (2006.01) |
| ***F02B 77/13*** | (2006.01) |
| ***G10K 11/162*** | (2006.01) |
| *G10K 11/16* | (2006.01) |
| *E04B 1/82* | (2006.01) |
| *E21B 43/26* | (2006.01) |

(52) U.S. Cl.
CPC ..... *G10K 11/162* (2013.01); *E04B 1/84* (2013.01); *E21B 43/26* (2013.01)

(58) Field of Classification Search
CPC .... G10K 11/162; G10K 11/168; G10K 11/16; E04B 2001/8423; E04B 2001/8452; E04B 1/8218; E04B 1/8227; E04B 1/84; F04D 29/663; F04D 29/664; F02B 77/13
See application file for complete search history.

(56) References Cited

U.S. PATENT DOCUMENTS

| | | | | | |
|---|---|---|---|---|---|
| 3,478,958 | A * | 11/1969 | Bowen | F04B 35/06 | 417/234 |
| 3,529,692 | A * | 9/1970 | Meier | E04B 1/8218 | 181/202 |
| 3,881,569 | A * | 5/1975 | Evans, Jr. | E04B 1/8218 | 181/200 |
| 4,751,979 | A * | 6/1988 | Wiseman | F02C 7/24 | 181/213 |
| 4,753,318 | A * | 6/1988 | Mizuno | B60R 13/08 | 181/204 |
| 4,753,319 | A * | 6/1988 | Vinciguerra | F01D 25/30 | 181/218 |
| 5,060,752 | A * | 10/1991 | Heiberger | E04B 1/8218 | 181/200 |
| 5,274,200 | A * | 12/1993 | Das | E04B 1/8218 | 181/202 |
| 5,681,072 | A * | 10/1997 | Stricker | B60R 13/0838 | 296/39.3 |
| 7,063,184 | B1 * | 6/2006 | Johnson | E04B 1/86 | 181/210 |
| 8,349,444 | B2 * | 1/2013 | Kipp | C04B 28/26 | 428/318.4 |
| 8,418,807 | B1 * | 4/2013 | Nevins | E04B 1/8227 | 181/210 |
| 9,587,649 | B2 * | 3/2017 | Oehring | H02K 9/04 | |

(Continued)

*Primary Examiner* — Edgardo San Martin
(74) *Attorney, Agent, or Firm* — Fennemore Craig, P.C.

(57) ABSTRACT

Provided herein is a system for reducing the overall noise output of equipment used in the hydraulic fracturing of oil and gas wells, by providing a noise-reducing enclosure and/or radiator which substantially reduce the level of noise that reaches the environment during normal operation.

20 Claims, 13 Drawing Sheets

(56) References Cited

U.S. PATENT DOCUMENTS

| | | | | |
|---|---|---|---|---|
| 9,702,143 | B2 * | 7/2017 | Perez | E04B 1/86 |
| 10,411,556 | B1 * | 9/2019 | Sakaray | H02K 7/1815 |
| 2006/0283657 | A1 * | 12/2006 | Dubensky | F24F 5/0075 181/200 |
| 2010/0212997 | A1 * | 8/2010 | Cho | E02F 9/00 181/200 |
| 2014/0305769 | A1 * | 10/2014 | Eiden, III | B65G 65/42 198/443 |
| 2015/0192117 | A1 * | 7/2015 | Bridges | F04B 23/06 417/53 |

* cited by examiner

REDUCED-NOISE HYDRAULIC FRACTURING SYSTEM

RELATED APPLICATIONS

This application claims benefit of priority to U.S. Provisional Patent Application No. 62/371,678 filed on Aug. 5, 2016.

BACKGROUND

Recent advancement and improvement of hydraulic fracturing technology has led to dramatic increases of both oil and gas production and reserves. The use of fracturing technology makes it economically viable to develop new geologic formations. As such, hydraulic fracturing is common for both newly drilled petroleum wells, and also established wells in which production in is decline. Therefore, hydraulic fracturing is an increasingly important aspect of oil and gas operations.

The hydraulic fracturing of an on-shore well is a large scale endeavor. Often a hydraulic fracturing operation requires ten to thirty different pieces of large equipment and, in some cases, millions of pounds of proppant and thousands of gallons of water to be injected in the well. United States Patent Publication 2014/0305769 to Eiden et. al provides a significant advance by densifying proppant storage for rapid deployment around a well site; however, it remains the case that this dense concentration of equipment may be very noisy—frequently producing sustained noise in excess of 110 dBA. Most modern fracturing jobs require several high-powered pumping units to generate the pumping pressure required to fracture the petroleum reservoir downhole, as well as a blender for mixing chemicals, water or gel, and proppant prior to pumping the mixture down the well. In cases where gel or polymer is used to suspend the proppant during pumping, a hydration unit also is required to mix and hydrate (and in some cases cross-link) the polymer gel system prior to providing the gel to the blender.

A major consequence of the power and breadth of the equipment necessary to create hydraulic fractures is noise. All hydraulic fracture equipment generates some noise, but blending units, hydration units and pumping units require large engines and radiators that are especially loud. In remote well locations, oil field workers can be protected by the loud noise by personal protective equipment. However, in well locations in close proximity to residential or commercial areas, noise represents a serious problem. Some local and state ordinances limit noise levels during certain hours or set maximum noise thresholds to protect residences and businesses. In some circumstances, performing hydraulic fracturing becomes difficult or impossible due to these noise restrictions, potentially limiting the viability of otherwise productive and economical wells.

SUMMARY

The presently disclosed instrumentalities advance the art and overcome the problems outlined above by providing for systems that significantly reduce the overall perceived noise output associated with hydraulic fracturing operations. This is done by the use of panels that are specially constructed to dampen and reflect noise. The panels may be attached to a frame and used to form a sound-damping enclosure that for noisier components of hydraulic fracturing equipment. The provided system is advantageously versatile and may be retrofitted onto existing equipment or installed upon initial manufacture. Further, the system provides a noise-reduced radiator which includes sound reducing panels in the inner body, and in some embodiments, reduces the fan speed required for cooling by altering the flow regime of air through the radiator.

According to one embodiment, a sound-damping panel for reducing noise of hydraulic fracturing equipment includes: (1) a mesh wall; (2) a channel joined with the mesh wall to present an inner space, the channel having wings and a bight where the bight presents an inner surface proximate the mesh wall; (3) a polymer sheet adhered to the inner surface; and (4) sound insulation substantially filling the inner space between the mesh wall and the polymer sheet.

In one aspect, the sound insulation may include a fibrous mat, such as rock wool or mineral wool.

In one aspect, the channel may be provided with ends that bend upward perpendicular to the wings, forming the interior space as a pocket.

According to one embodiment, the aforementioned sound damping panels may be utilized in a retrofit assembly for mitigating noise pollution emanating from roadable oilfield hydraulic fracturing equipment, such as a pumping unit, a blender or a hydration unit. The retrofit assembly includes: (1) a frame that is constructed and arranged for attachment to a chassis of the roadable oilfield hydraulic fracturing equipment, the frame including a plurality of modular area subdivisions adapted for mounting a first set of the sound damping panels; (4) at least one door configured to provide access to an interior enclosed space of the retrofit assembly. The retrofit assembly is configured to enclose a portion of the roadable oilfield equipment, thereby decreasing the external noise output of the equipment.

In one aspect, the retrofit assembly is a pumping unit that includes an engine and a radiator. The retrofit assembly is effective for reducing a normal operating C-weighted noise output of the pumping unit to a value of less than or equal to 90 dBC, and for reducing a normal operating A-weighted noise output of the piece of the pumping unit to less than or equal to 80 dBA.

In one aspect the radiator may be formed as a plurality of radiator bodies that define an interior radiator space capped by a fan. The second set of sound damping panels is positioned in the interior radiator space so as to disrupt a line of sight between the radiator bodies. The second set of sound damping panels may be mounted in this interior space so that each panel rises at an angle from a proximate radiator body towards the fan. This facilitates a consequent reduction of fan horsepower as compared to horsepower requirements for equivalent movement of air if the first set of sound damping panels were not in place.

In one aspect, the door of the retrofit assembly may be a reefer door.

In one aspect, the retrofit assembly may be provided with a louvre permitting a flow of air into the enclosure, the louvre having slats oriented to direct sound emanating from within the enclosure downward towards the ground. Further, the slats may be coated with a polymer to facilitate absorption and the direction of sound.

In one aspect, the retrofit assembly may provide a roof. The roof may be provided with an upward opening for discharge of air through the fan.

According to one embodiment, the retrofit assembly is installed on the chassis of a piece of roadable oilfield hydraulic fracturing equipment and noise mitigation is achieved when the combined assembly is utilized in the performance of a hydraulic fracturing operation

DETAILED DESCRIPTION

The instrumentalities described below teach by way of example and not by limitation. Accordingly, the discussion should not be used in a manner that unduly limits what is claimed.

Figure 1:
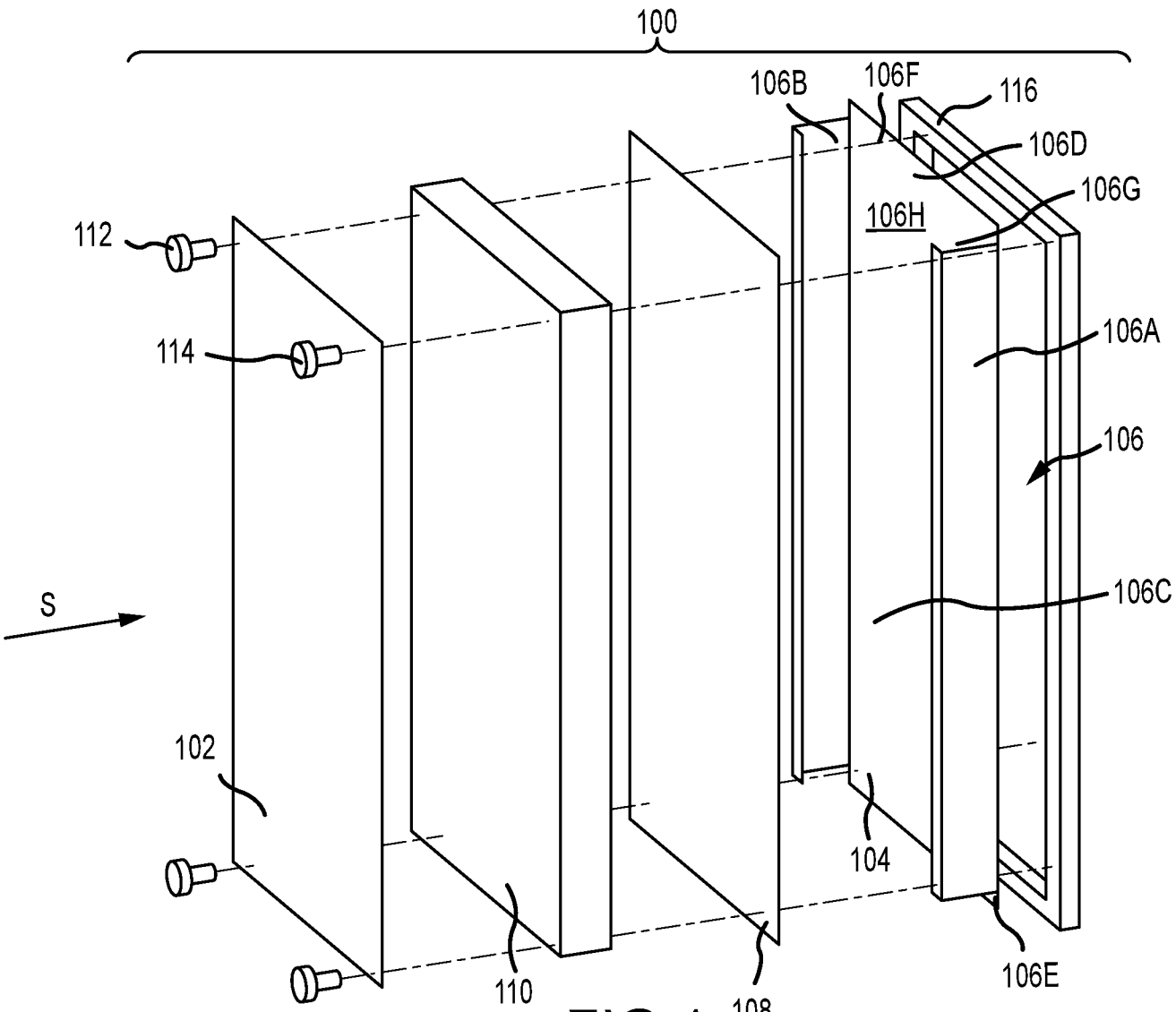
FIG. 1 provides an assembly view of a sound damping panel according to one embodiment.

FIG. 1 is an assembly view of an elongate sound damping panel 100. The panel 100 is installed on hydraulic fracturing equipment to reduce overall noise output. Panel 100 is not shown to scale. In actual use, the panel 100 will have dimensions according to a need to cover a predetermined area or object for noise mitigation purposes. Panel 100 may be provided, for example, as a retrofit assembly enclosing an engine or one that does not form an enclosure but dampens and reflects noise into the ground.

An inner wall 102 is positioned proximate to or generally facing the a noise source or sound S. The inner wall 102 is preferably a mesh, such as a mesh formed of composite material, steel, aluminum or copper mesh. Steel mesh is preferred for ruggedness in the intended environment of use. The mesh openings facilitate the passage of sound S through the inner wall 102. An outer wall 104 is remote from the inner wall 102. The outer wall 104 is solid metal or composite matching the material of inner wall 102.

Outer wall 104 is formed as an elongate channel 106 having wings 106A, 1066 and a bight 106C. The bight 106C extends along the length of Outer wall 104 beyond wings 106A, 1066 to form shelves 106D, 106E, which extend beyond the wings 106A, 106B and have apertures such as apertures 106F. 106G formed therein for a passage of bolts 112, 114. A polymer layer 108 resides on surface 106H of bight 106C. The polymer layer 108 may be, for example, a spray-on rubberized coating or a polyethylene or polyurethane sheet adhered to surface 106H by application of a viscoelastic polymer. More generally, the polymer 108 may be a rubber, polyurethane, polyethylene, spray-on polymers, or a mass-loaded polymer (such a mass loaded polyvinyl). The primary function of polymer layer 108 is to reflect sound.

Sound insulation 110 is placed between the polymer 108 and the inner wall 102 to act as a sound-damping baffle. Sound insulation 110 may be any type of sound insulation known to the art, but fibrous mat materials are particularly preferred. The fibrous mat materials include, without limitation, fiberglass, blown insulation, mineral wool, rock wool, and combinations of these materials. It will be appreciated that the shelves 106D, 106E may be bent upward to make a pocket (not shown) to contain the inner wall 102, sound insulation 110, and polymer 108, or else additional plate material (not shown) may be welded in place for the same effect of providing a pocket In use, the inner and outer walls 102, 104 are bolted together bolts such as bolts 112, 114, which each extend through inner wall 102, sound insulation 110, polymer layer 108, and channel 104 to threadably couple with a welded nut (not shown) on supportive frame 116. The frame 116 may be any shape, and may be adapted for coupling with a chassis of roadable oilfield equipment for use in hydraulic fracturing operations. As used herein, "roadable" means a conveyance that is a wheeled vehicle or trailer capable of travelling on a road.

The assembled panel 100 is placed upon the supporting frame 116 in an orientation with inner wall 102 facing sound source S. The supporting frame is preferably covered with a coating as described above for the polymer layer 108. The sound source S may be, for example, a large engine, pump or a radiator fan. The sound S enters panel 100 on a pathway extending through the mesh of inner wall 102 and into the sound insulation 100 where the sound is absorbed and baffled. Most of the remaining sound on this pathway reflects off of polymer layer 108 and back into the sound insulation 110 for additional absorption/baffling before exiting panel 100 on a redirected sound-reflective pathway through the mesh openings of inner wall 102.

The thickness of panel 100 along the path of sound S may be adjusted to optimize the sound damping effect in the intended environment of use. It has been observed that dBC measurements are about ten points higher than dBA measurements, and much of the increase comes at the lower end of the dBC dynamic range. Since it is desirable to have a thickness of at least about ¼ of the sound wavelength for sound damping purposes, and due to the particular wavelengths of sounds emitted by fracking equipment, this suggests that the thickness of panel 100 is preferably at least about four inches (10 cm).

The range of human hearing is approximately from 20 Hz to 20 kHz, such that the wavelengths range from about 56 feet to a quarter inch (17 m to 17 mm). It presents a problem to have panels ¼ of the sound wavelength at the lower end of this range. On the other hand, these low frequency sounds travel farthest in the sense that they can be heard from longer distances away from the source. The low end of the spectrum is also one that is irksome to people, particularly when it is from proximate an intense source. It is therefore helpful that, in addition to the panel thickness strategy for damping sound, the panels are directionally oriented for multiple sound reflections between panels that are oriented to reflect sound off one another with consequent baffling on each reflection pathway. The ultimate sound reflection pathway is either up or down. This directional orientation makes the sound less perceptible from a position spaced laterally away from the source.

Panels like panel 100 may be constructed in any shape and dimension. The panels may be used in walls, ceilings and floors.

Figure 2:
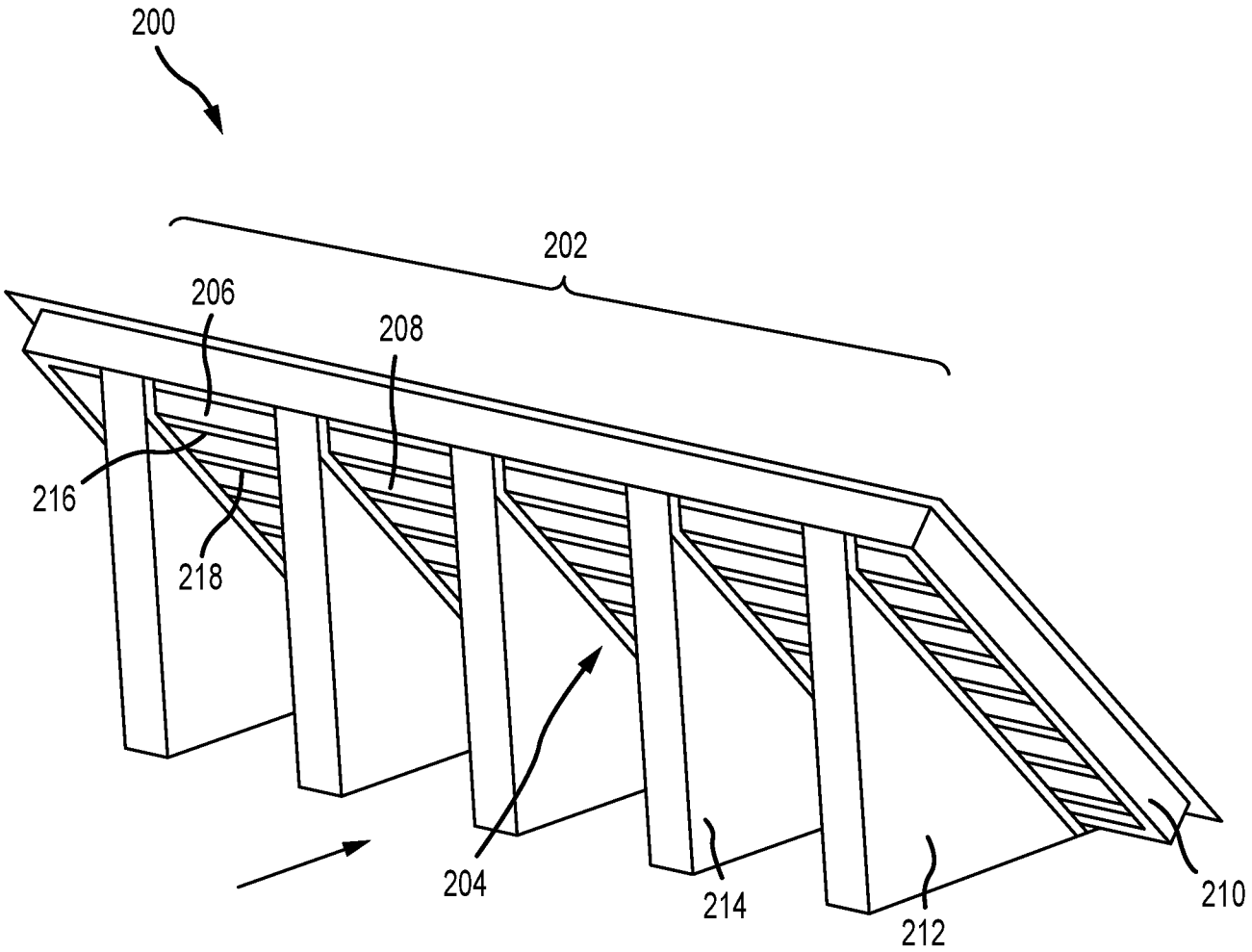
FIG. 2 shows an air louver that may be used in an enclosure assembly for purposes of noise mitigation.

FIG. 2 provides an inner view of an example of a noise-reducing air louver 200. In some instances it will be impractical to completely cover or enclose a noisy component of the hydraulic fracturing equipment, and the air-louvre 200 may be utilized in those situations. The louver 200 has a slotted external surface 202 which allows for the flow of air through to the internal surface 204. This may provide, for example, air to an internal combustion engine (not shown) through opening between slats 206, 208, which are held in place by a perimeter frame 210 and supported by a series of struts 212, 214. The entire exterior surface 202, including all exterior surfaces of slats 206, 208, may be covered with a rubberized or polymer coating for the reflection of sound S. The polymer coating may be, for example, polyurethane, polyethylene or mass-loaded polyvinyl. The perimeter frame 210 and struts 212, 214 may retain slats 206, 208 in a fixed spaced relationship with openings 212, 214 oriented such that air flowing in the direction of sound S will travel down. Thus, in the intended environment of use, the coated exterior surface 202 reflects sound S down and into the ground.

Figure 3:
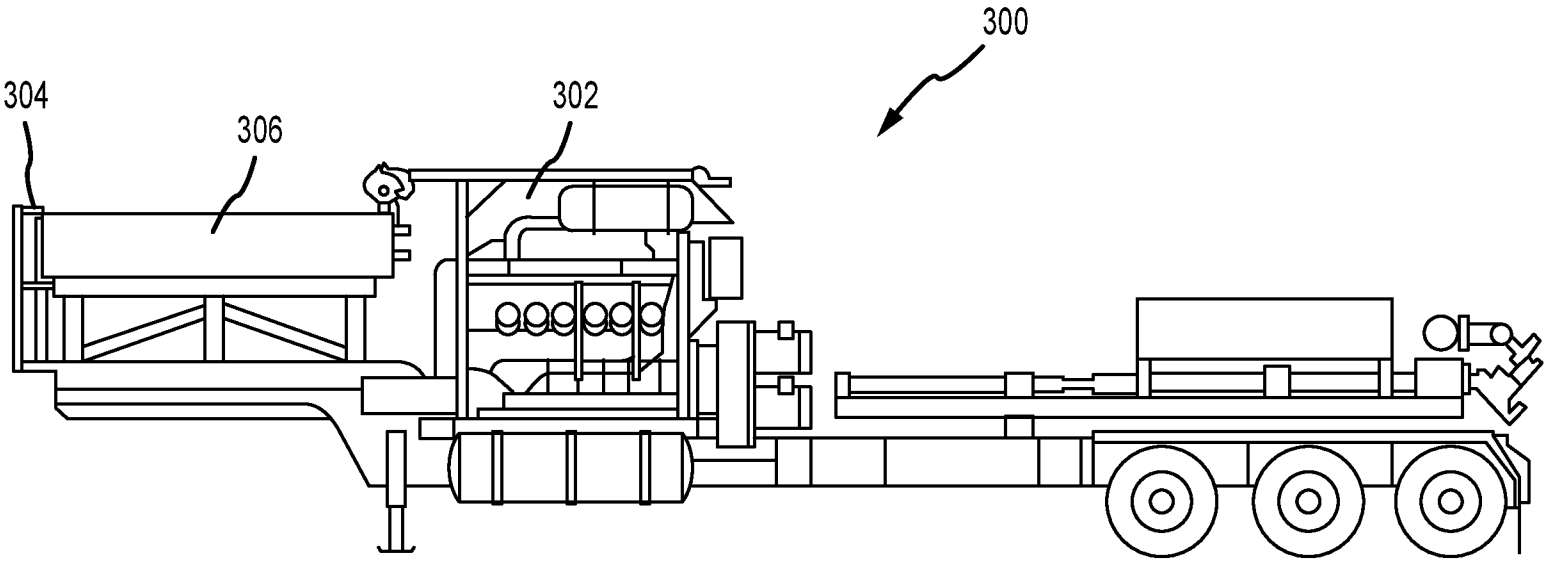
FIG.3 PRIOR ART
FIG. 3 provides an example of a hydraulic fracturing pumping unit of the prior art that has not been modified to reduce noise.
Figure 4:
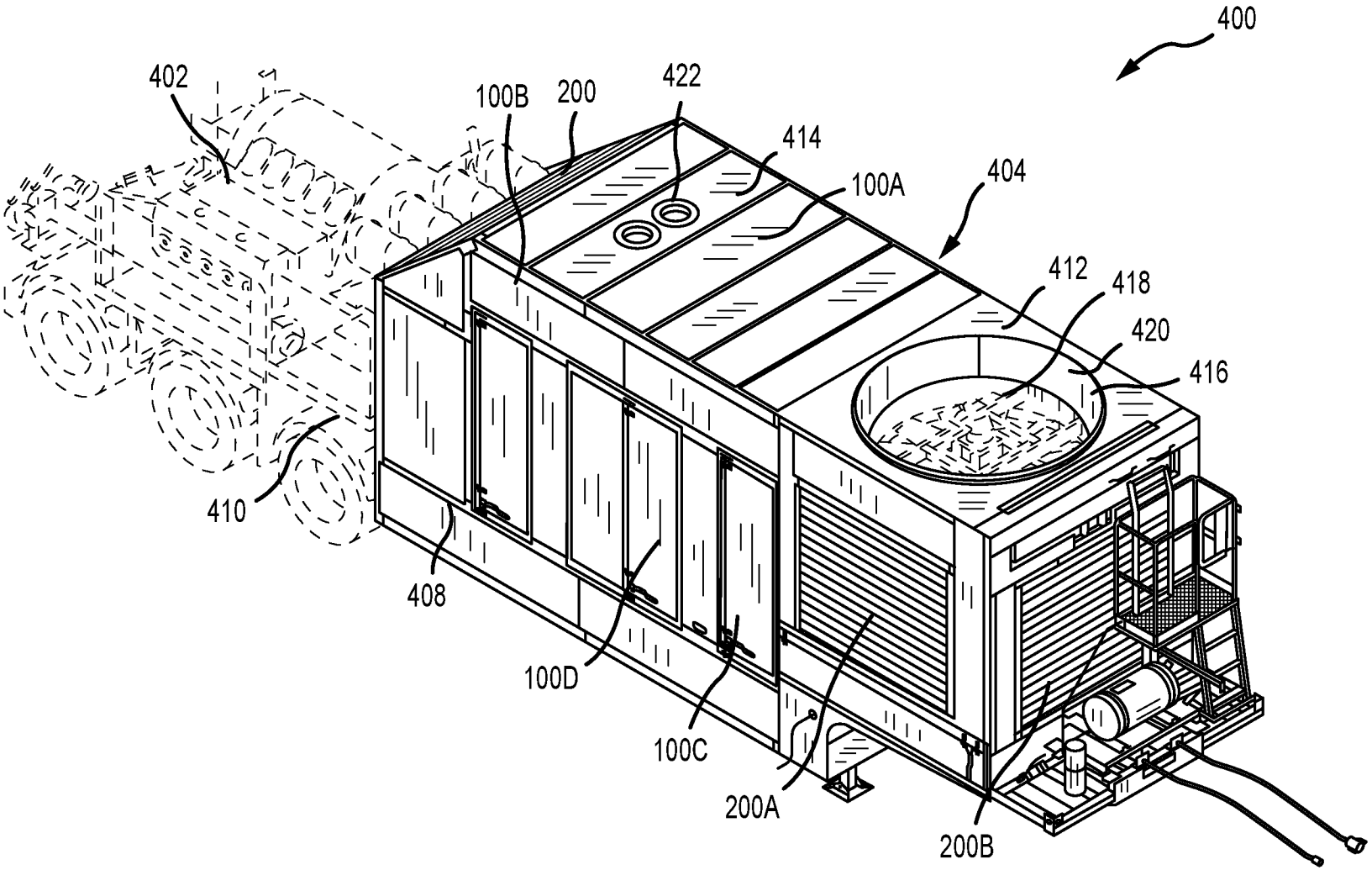
FIG. 4 provides a hydraulic fracturing pumping unit as a retrofit assembly with components enclosed to reduce noise output.

FIG. 3 shows an example of typical hydraulic fracture pumping unit 300 according to the prior art, for example, as described in United States Patent Publication US 2015/0192117. FIG. 4 illustrates a similar unit 400 that has been retrofitted according to the presently disclosed instrumentalities to reduce noise output during hydraulic fracturing operations. In FIG. 3, the engine 302 and radiator 304 are exposed. The engine has a large displacement and may generate, for example, more than 110 dBA during normal use. The radiator 304 forms a square enclosure known to the art, and is topped by an upwardly oriented fan 306 that is only slightly less noisy than engine 302. Any noise generated by the equipment is transmitted to the nearby environment.

In FIG. 4, the engine 302 and radiator 304 are not visible. A pump 402 used to move the hydraulic fracturing fluid is an area of high activity and relatively low noise output, and so the pump 402 is left uncovered. Use of dashed lines to illustrate pump 402 in FIG. 4 indicates that, according to this embodiment, the pump 402 is not located within a sound reducing enclosure 404. This enclosure 404 greatly reduces machine noise from the engine 302 and radiator 304, which reside within the enclosure 404. The enclosure 404 is made primarily of noise-reducing panels 100A (top), 1006 and 100C (side), and 100D (door) using the same layered construction as shown above for panel 100 in FIG. 1. It will be understood that the enclosure 404 has a floor (not shown) which is preferably also made of panels constructed as panel 100. In some embodiments, one or more of ports (not shown) may be installed as latched access doors, such as panel 100D which may be provided as a reefer door. Similar panels may be installed over smaller portals installed through any of panels 100A-100D to allow external access to control panels, electronics, valves or similar components as needed to expedite maintenance operations. For larger, more complex repairs and maintenance any panel on the enclosure 404 can simply be unbolted from the support frame 408 where it resides of trailer 410, providing unimpeded access to the enclosed components.

The enclosure 404 may also include louvers 200A, 200B as described herein (see FIG. 2). The louvers 202A and 202B are positioned to facilitate air intake for internal components including engine 302, as well as radiator 304. The exact dimensions of the engine 302 and radiator 304 are not of particular importance, since similar components of various sizes are known to the art and the enclosure 404 may be adapted in size and construction to enclose these components as they are presented on a particular pumping unit. The panels 100A to 100D and louvers 200A, 200B are held in place by a rectilinear support frame 408 which, for example, may be square iron or channel iron that is bolted directly to the existing chassis or frame structure of the pumping unit 400. This iron may be coated with a sound damping material, such as a laminate or rubberized material. This structure allows the noise reduction system of enclosure 404 to be employed on existing pumping units via retrofit assembly or installed during the manufacture of new units.

Certain panels made in the manner of panel 100 are provided with through openings for the direct discharge of noise into the environment. These include panels 412, 414. Panel 412 is provided with opening 416 for the discharge of noise and air from fan 418. This discharges occurs in an upwards direction from a fan 418, which discharges from a sunken position through drop wall 420. Openings 422 in panel 414 similarly provide for the discharge of noise and exhaust, also in an upward direction. This shows that, in instances where some discharge must occur such as in the case of radiator air or exhaust, perceived noise from a perspective to the side is mitigated by discharging the noise I a directional orientation that is either up or down, but not to the side. A louver (not shown) is optionally used to cover opening 416.

Figure 5:
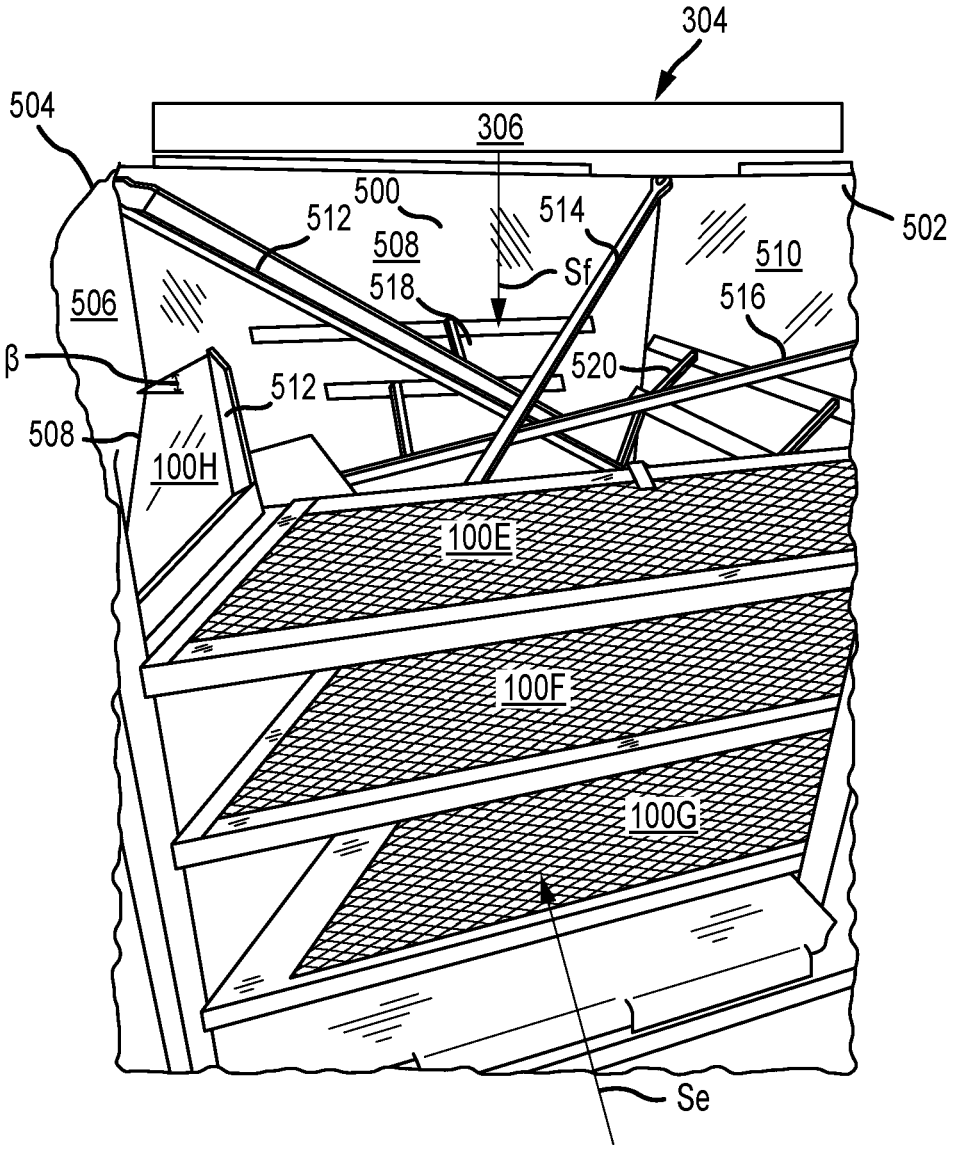
FIG. 5 shows an inner view of a radiator with sound-damping panels positioned in the inner body.

FIG. 5 illustrates the radiator 304 retrofitted with a plurality of panels that are made in the same manner as panel 100, such as panels 100A, 100B. The radiator 302 includes four interconnected radiator bodies, such as radiator bodies 500, 502, 504. As shown in FIG. 5, one of the radiator bodies has been removed to reveal the panels 100E, 100F, 100G, 100H. Each of the radiator bodies 500-504 presents a vertical corrugated wall, such as walls 506, 508, 510, that permit air to pass for purposes of reducing internal coolant, as is well known in the art. In this instance, the noise source S is engine 302 (see FIG. 3). Each of the panels, such as panel 100A, rises from a first position 508 adjacent a radiator body, e.g., radiator body 504, towards a second position 512 remote from the radiator body internal to the radiator 304. The angle of rise ß is preferably from 30° to 60° relative to horizontal, with an angle of from 40° to 50° being more preferred. Cross-supports 512, 514, 516 support the radiator bodies 500-502 and impose dimensional constraints affecting the placement of panels 100E-100H. Interior braces, such as braces 518, 520 lend support between adjacent panels.

It will be appreciated that the panels 100E-100H, taken altogether, form walls that may be utilized in place of louvers 200A and 200B of FIG. 4. These walls may also be located just inside of louvers 200A, 200B for use in combination therewith. The panels 100E-100H are oriented with the mesh of inner wall 102 facing generally up and towards the radiator bodies 500-504 for sound collection. In this orientation, the panels 100E-100H mitigate the engine noise from source Se, as well as fan noise Sf from fan 302 (see FIG. 3). Placement of the panels 100E to 100H preferably occurs such that there is no direct line of sight between the respective radiator bodies 500-504 of radiator 302. For larger engines, the radiator fan 306 may emit as much or more noise than does the engine. In one example of measurements, a large engine on a pumping unit was emitting 107 dBA, and the fan was determined to emit at about 103 dBA.

In addition to the sound damping function in the arrangement shown in FIG. 5, the rising orientation of panels 100E-100H have been shown to provide an unexpected benefit. It was determined that the fan 306, which was a hydraulically driven fan operating at 1000 rpm, once retrofitted with the assembly as shown in FIG. 5 was able to move an equivalent volume of air at a speed of only 600 rpm. Thus, equivalent cooling was obtained with a 50 horsepower reduction. Without being bound by theory, this suggests that the orientation of panels 100A, 100B facilitates laminar flow within the radiator 304. Experimental results show large reduction in fan speed, for example 40-50% reductions, to fan speeds of approximately 600 rpm. This reduction of fan speed significantly reduces the noise generated by the radiator unit and, consequently, increases the overall sound reduction of the pumping unit 400.

Figure 6:
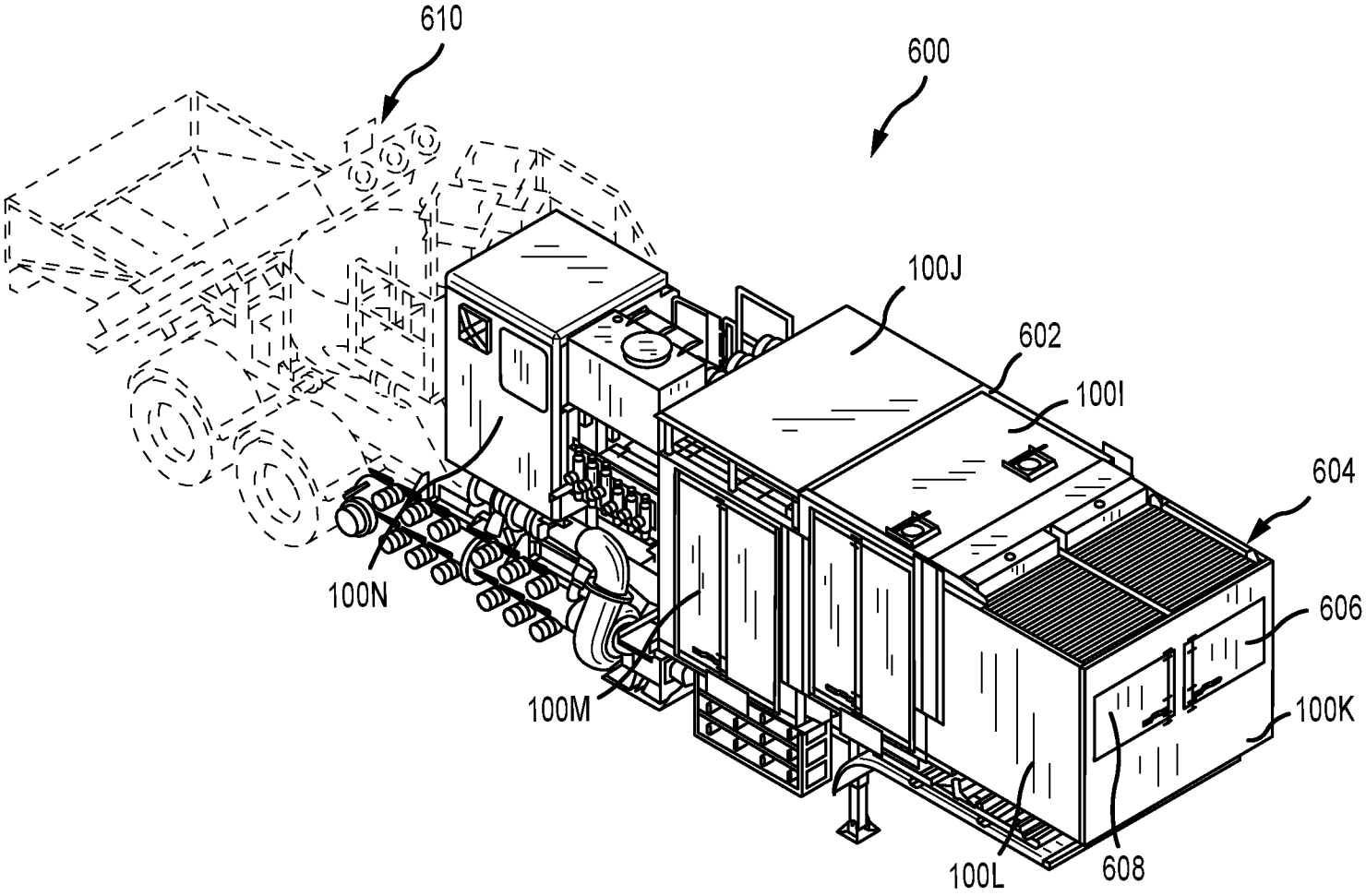
FIG. 6 provides a hydraulic blending unit with components enclosed to reduce noise output.

FIG. 6 illustrates a hydraulic fracturing blending unit 600 with a noise-reducing enclosure 602 designed to reduce the overall sound output from components of the blending unit. These components may include, for example two engines and a radiator. Similarly to the enclosure for a pumping unit 400 as described in FIG. 4, the enclosure 602 is composed of noise reducing panels 100I, 100J, 100K, 100L, 100M, 100N, which are formed in the same type of layered construction as is panel 100 (see FIG. 1) and air louver 200. It will be understood that the enclosure 602 has a floor (not shown) which is preferably also made of panels constructed as panel 100. Panel 100N is formed as one of several reefer doors that provide internal access to the confines of the enclosure 602. Typical blending units do not have the same power requirements of a pumping unit, and so blending units tend to have smaller engines and radiators than do the pumping units. However, for large blending units, the noise-reduced radiator 304 described in FIG. 5 and throughout the present application may also be implemented on the blending unit 600.

A rear section 604 houses a single radiator body with sound-adsorbing panels 606, 608 oriented to receive engine and fan noise from within the enclosure 602, dampen the noise, and redirect remaining noise towards the ground. These panels 606, 608 are bolted to an internal support frame (not shown). A blender area 610 is an area of high activity with relatively low noise output, and this area may emit significant amounts of dust, so it is left uncovered. Use of dashed lines to illustrate the blender area 610 in FIG. 6 indicates that, according to this embodiment, the blender area is not located within the sound reducing enclosure 602.

Figure 7:
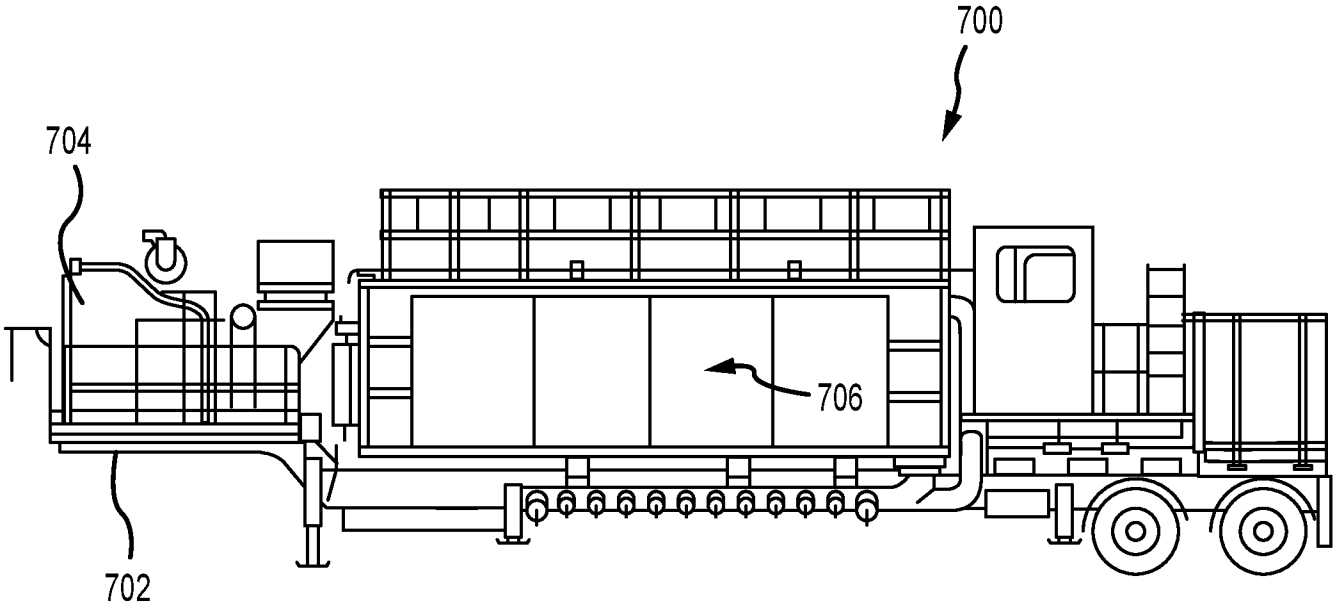
FIG.7 PRIOR ART
FIG. 7 shows a hydraulic fracturing hydration unit of the prior art, which has not been modified to reduce noise.
Figure 8:
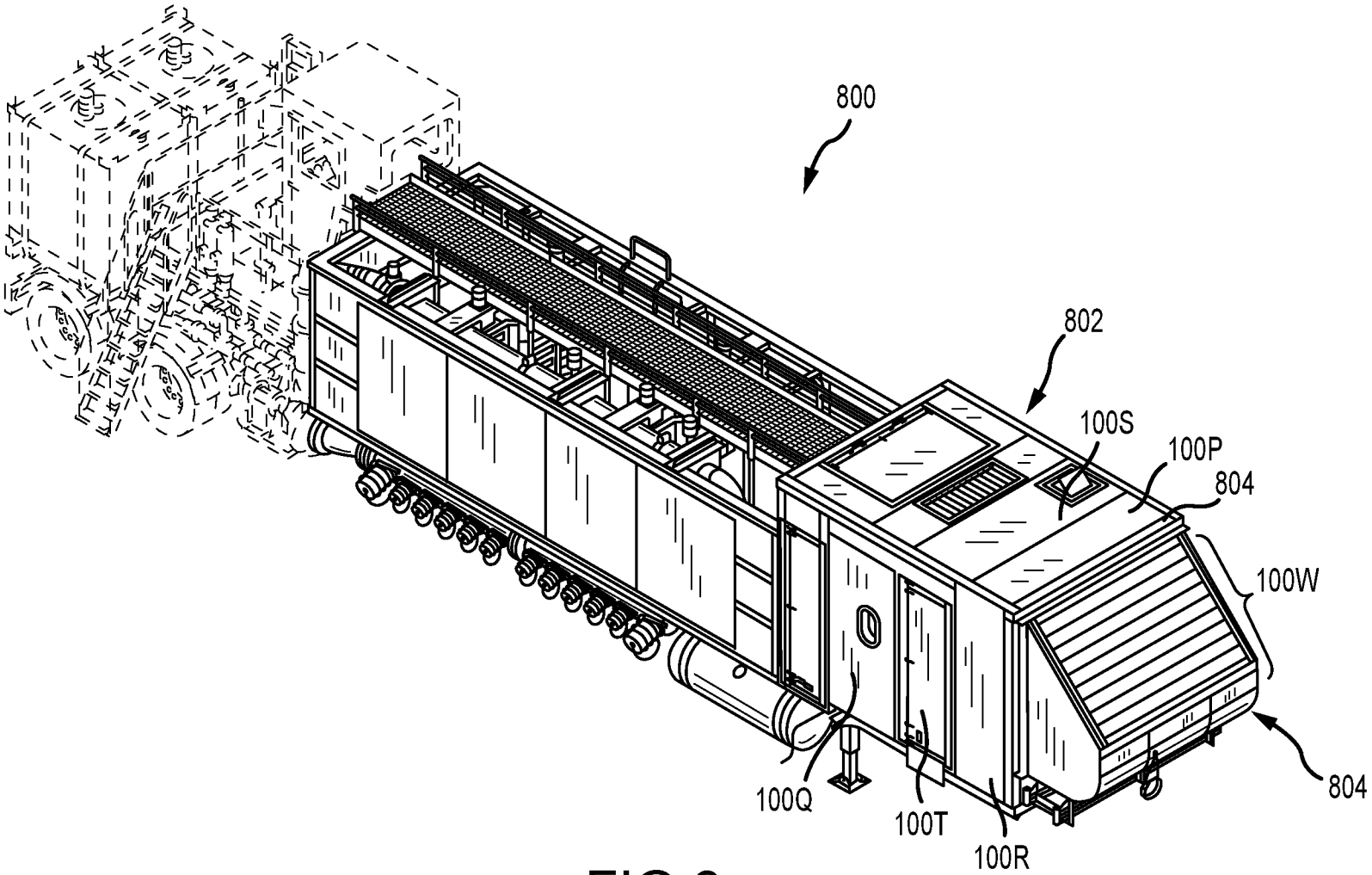
FIG. 8 shows a hydraulic fracturing hydration unit as a retrofit assembly with components enclosed to reduce noise output.

FIG. 7 shows a hydraulic fracturing hydration unit 700 of the prior art. The hydration unit includes an engine 702 with radiator 704 used to power mixing of liquids in compartmentalized mixing tanks 706. FIG. 8 shows retrofit hydration/mixing assembly 800 enclosing the engine 702 and radiator 704 of the underlying hydration unit 700 (see FIG. 7). A sound reducing enclosure 802 includes panels 100P, 100Q, 100S, 100T, which are made in the manner shown in FIG. 1 and attached to frame 804. It will be understood that the enclosure 404 has a floor (not shown) which is preferably also made of panels constructed as panel 100. Panel 100T is formed as a reefer door that provides access to the interior of enclosure 802. A downwardly angled protruding nose 806 contains sound damping panels 100W oriented to receive noise from the engine 702 and radiator 704 for absorption/damping and redirection of remaining sound towards the ground. Alternatively, the panels 100W may be replaced by a louver 200 as shown in FIG. 2.

Figure 9:
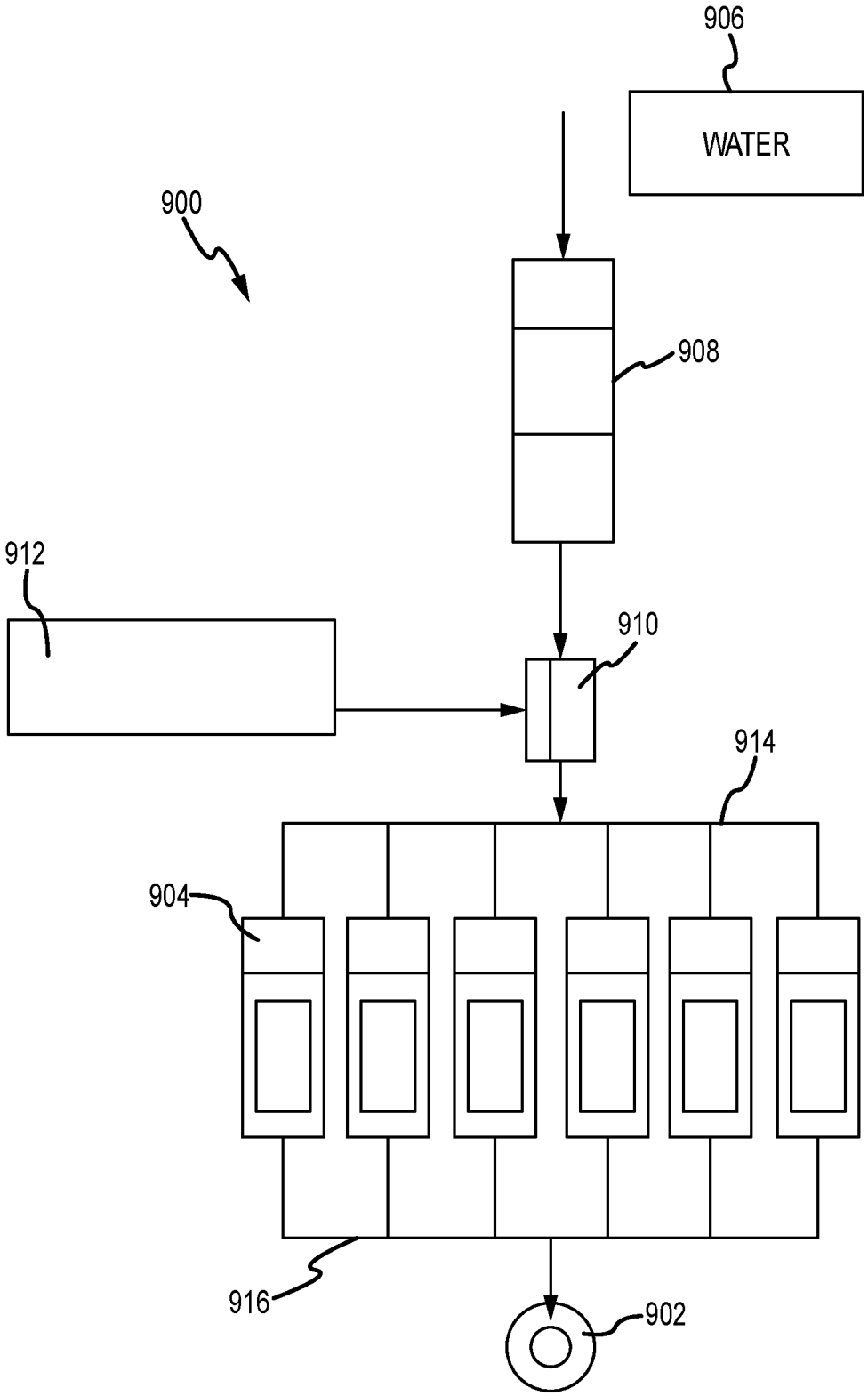
FIG. 9 is a schematic representation of a hydration unit, a blender and a plurality of pumping units grouped together for performance of a hydraulic fracturing operation in stimulating a well.

FIG. 9 shows a noise-reduced hydraulic fracturing system 900 in fluid communication to an oil or gas well 902 to fracture the well 902. A plurality of noise-reduced hydraulic fracturing pumps 904 are pumping in tandem, in order to provide the pressure required for purposes of hydraulic fracturing and deliver the fluid and proppant to the downhole reservoir of well 902. Water 906 feeds a hydration unit 908 which, in turn, feeds a blender 910. In fracturing operation utilizing a gel or polymer system, the base polymer/gel is mixed with water in the hydration unit 908 before being pumped to the blender 910. In some embodiments, additional chemicals, for example, friction reducer, corrosion inhibitor, cross-linker, cross-link breaker or other chemicals may be introduced to the fluid in either the hydration unit 908 or the blender 910. The blender 910 receives proppant 912, combines the same with effluent from the hydration unit 908, and supplies the resulting mixture to a low pressure side 914 of the group of fracturing pumps 904 for downhole injection into well 902 from high pressure side 916. The hydration unit 908 may be, for example, hydration unit 800. The blender 910 may be, for example blender 600. The pumping units of group 904 may be, for example, the same as pumping unit 400.

Figure 10:
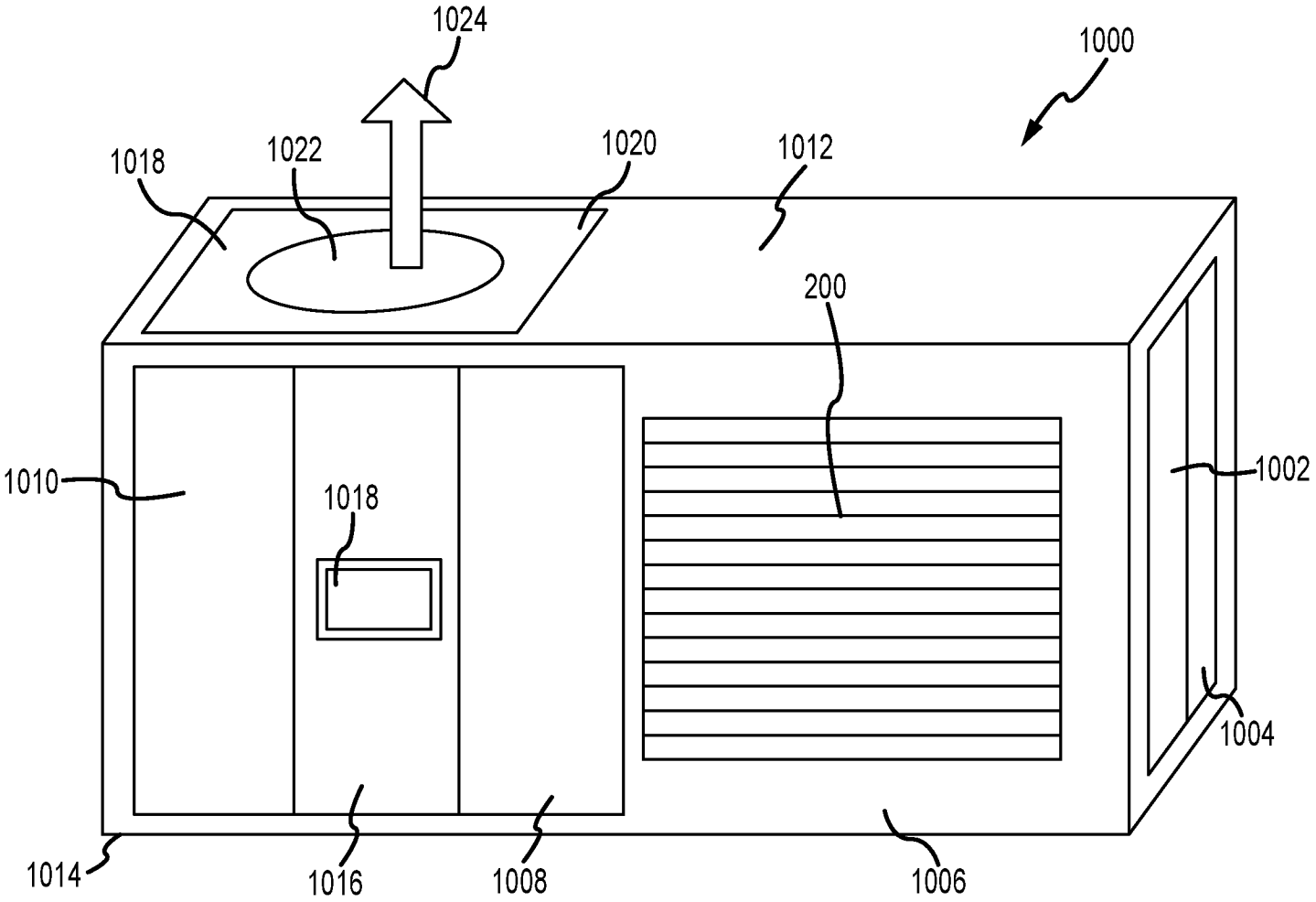
FIG. 10 shows an enclosure according to one embodiment of the presently disclosed instrumentalities.

FIG. 10 shows an additional example of an enclosure 1000, such as may be used for enclosure 400 of FIG. 4. The enclosure 1000 includes noise-reducing panels such as panels 1002, 1004, 1006, 1008, 1010 and a roof 1012, all of which have the same layered construction as shown in FIG. 1, and all of which are bolted into frame 1014. A sound damping panel 1016 has a built-in control panel 1018 that may be accessed for control of an engine or other noisy mechanical systems (not shown) inside the enclosure 100. An opening 1020 permits fan 1022 to discharge air 1024 in an upward direction. The fan 1022 pulls air 1024 through louvres 200 for cooling purposes, as well as operation of the internal engine.

Figure 11:
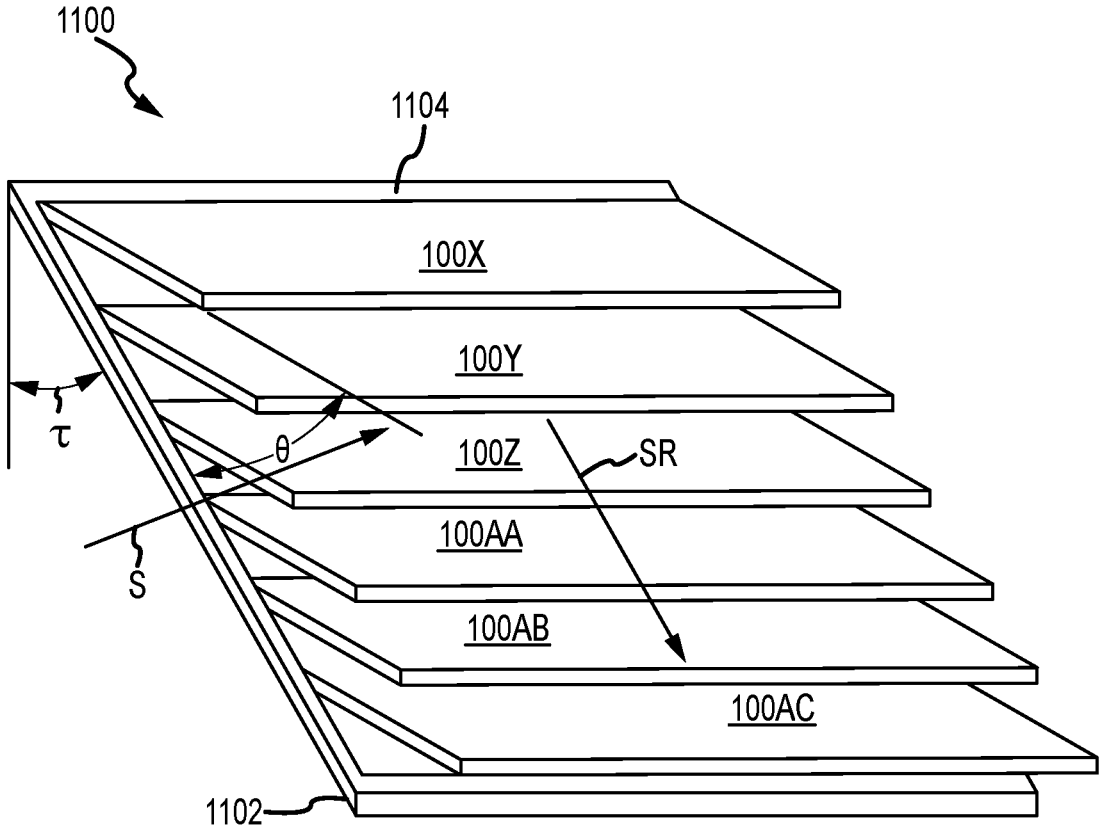
FIG. 11 shows wall that contains a plurality of sound damping panels deployed for mitigation of engine and radiator fan noise.

FIG. 11 shows a panel wall 1100 that may be used in place of protruding louver 200 or any of walls 100W, 606, 608, 100E-H described above. A rectilinear frame 1102 may be used to bolt the panel wall 1100 onto a supportive frame, such as frames 408, 804 and 1014 shown above. Sound damping panels 100X, 100Y, 100Z, 100AA, 100 AB, 100AC are built in the same manner as panel 100 (FIG. 1) and are oriented with respect to two angles, θ and T. In context of panel 100, the mesh of inner side 102 faces generally down such that reflected sound travels on a downward trajectory towards the ground. The angle T indicates a departure of frame 1102 from vertical. For example, T is zero when frame 1102 is plumb. The angle θ indicates a departure of panel 100X from frame 1102, and the same is true of panels 100Y-100AC as these are positioned in parallel to panel 100X. It will be understood that the thickness presented to sound S in a direction normal to the plane defined by front surface 1104 of frame 1102 varies as a Pythagorean function of angles θ and T. The sum of angles θ and T is preferably from 30° to 60° relative to horizontal, with a sum of from 40° to 50° being more preferred. Thus, it is possible to provide panels 100X to 100AC with a thinner construction that presents a greater thickness to the travel of sound and has the additional advantage of reflecting sound SR more directly towards the ground. Placement of the panels 100X to 100AC preferably occurs such that there is no direct line of sight extending from a target noise source, such as an engine, radiator or pump, through the panel wall 100.

Figure 12:
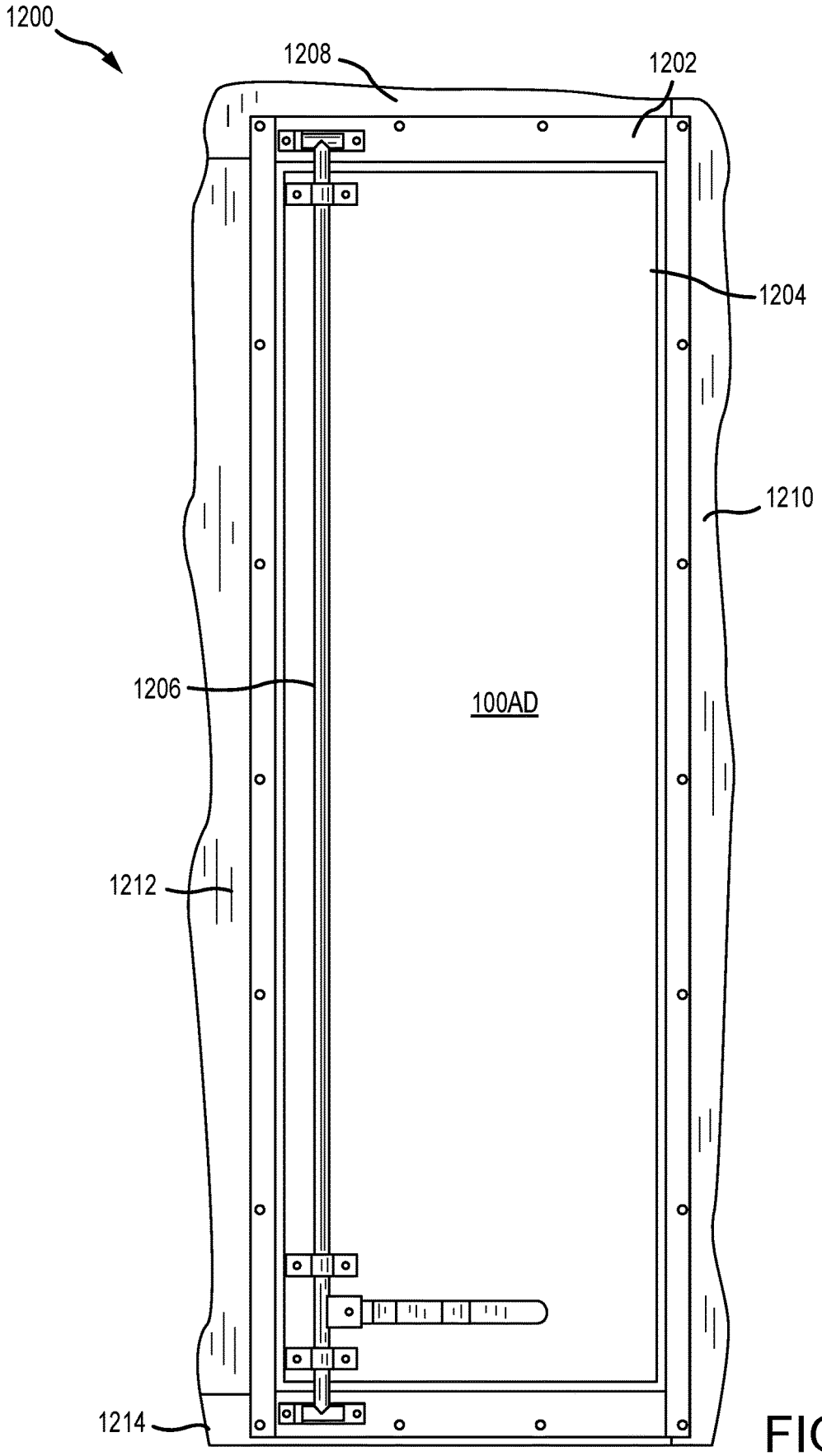
FIG. 12 shows a reefer door constructed with a sound damping panel.

FIG. 12 shows a reefer door 1200 that may be used in place of any of the panels 100D, 100N, 100T, which are described above as being reefer doors. A panel 100AD is hinged to frame 1202 and sized to cover opening 1204. Panel 100AD is made using the same layered construction as shown above for panel 100. A latch mechanism 1206 may be any latch mechanism in common use for securing a reefer door in transit. Hinges (not shown) are provided to permit the panel 100AD to swing on a vertical axis when the latch mechanism 1206 is unlocked to provide egress through opening 1204. The frame 1202 is bolted to a support frame 1214 that carries the reefer door 1200 as well as adjacent panels 1208, 1210, 1212 forming any of the sound-resistant enclosures discussed above.

Figure 13:
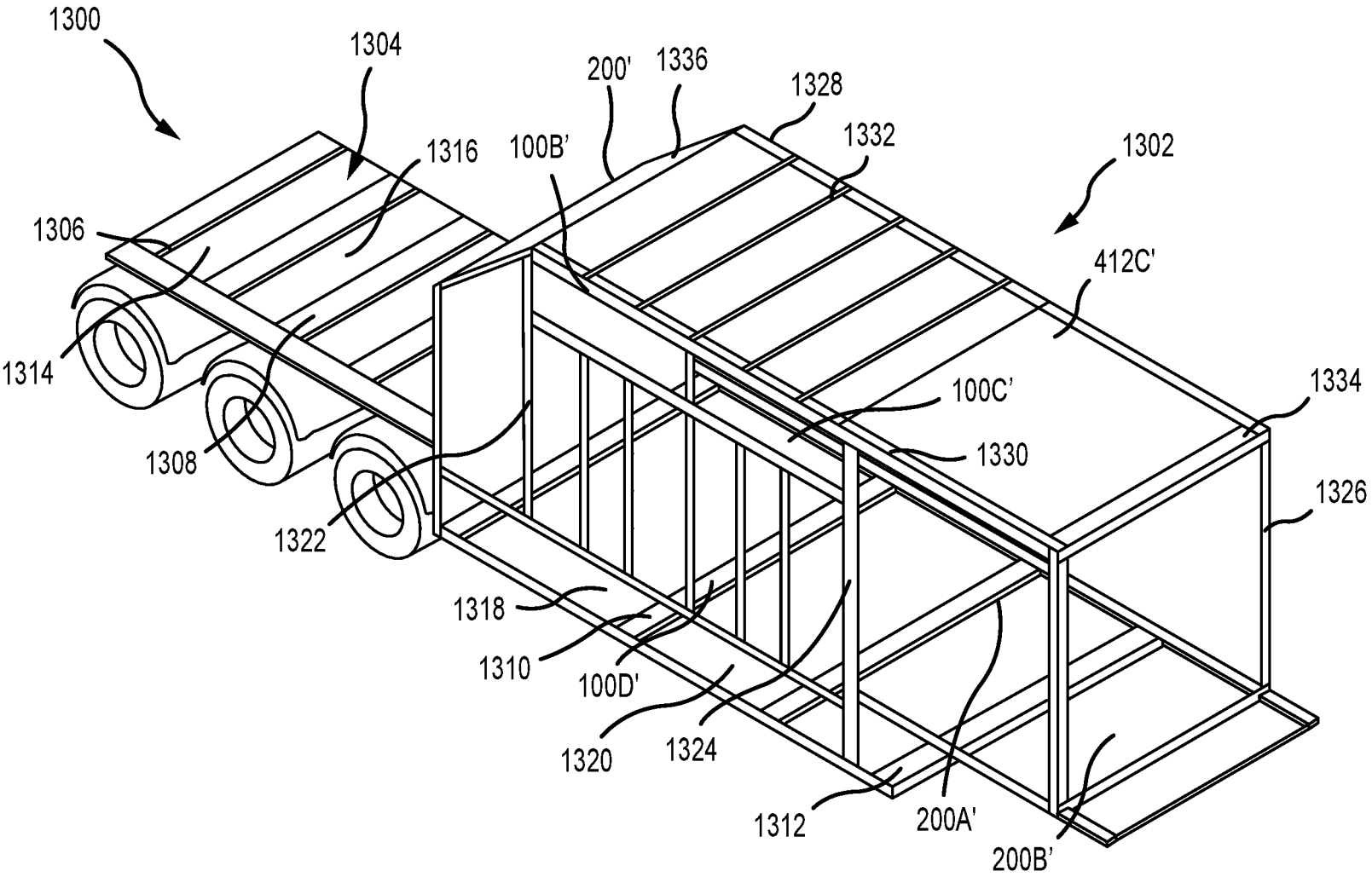
FIG. 13 shows a trailer that has been fitted with a frame for support of sound damping panels

FIG. 13 shows a trailer 1300 that has been fitted with a frame 1302. The frame is constructed and arranged to support sound damping panels such as panels 100A-100D and 412, together with and louvers 200, 200A, 200B as shown in FIG. 4. The trailer 1300 has a conventional deck 1304. As shown, the deck 1304 is provided with floor beams, such as beams 1306, 1308, 1310, 1312 for support of heavy equipment, such as pumps, engines, radiators and the like. The floor beams 1306-1312 define spaces 1314, 1316 1318, 1320, which are provided for receipt of panels constructed in the manner of panel; 100 shown in FIG. 1. Atop the deck 1304, the frame 1302 includes a plurality of upright posts 1322, 1324, 1326, longitudinally oriented horizontal members 1328, 1330, transversely oriented horizontal members 1332, 1334, and sloped member 1336. These structural members define rectilinear opening for receipt of panels 100A-100D and 412, including openings 100A', 100B', 100C' and 100D'. The structural members of frame 1302 also provide louver openings 200', 200A', 2006'. The respective panels and louvers may be bolted to the frame 1302.

The structural members themselves may provide a pathway for sound transmission outside of that inside the sound damping panels. To reduce the magnitude of such transmission, all surfaces of deck 1304 and frame 1302 are preferably covered with a sound reflective polymer, such as a spray-on rubberized coating or a polyethylene or polyurethane sheet adhered by application of a viscoelastic polymer. The polymer 108 may be, for example, a rubber, polyurethane, polyethylene, spray-on polymer, or mass-loaded polymer (such a mass loaded polyvinyl).

Those skilled in the art will appreciate that what is shown and described may be subjected to insubstantial changed without departing from the true scope and spirit of invention. Accordingly, the inventors hereby state their intention to rely as needed upon the Doctrine of Equivalents in protecting their rights to the invention.

I claim:

1. A sound-damping panel for reducing noise of hydraulic fracturing equipment comprising:

a mesh wall presenting a generally planar surface, a channel joined with the mesh wall to define an inner space between the mesh wall and the channel, the channel having a pair of wings and a bight connecting the pair of wings, the bight being made of a solid material presenting an inner planar surface oriented in parallel with the generally planar surface the mesh wall, a polymer sheet adhered to the inner planar surface, and sound insulation substantially filling the inner space between the mesh wall and the polymer sheet.

2. The sound damping panel of claim 1 wherein the sound insulation includes a fibrous mat.

3. The sound damping panel of claim 2 wherein the fibrous mat is formed of mineral wool.

4. The sound damping panel of claim 2 wherein the channel has ends perpendicular to the wings to form the interior space as a pocket.

5. A retrofit assembly for mitigating noise pollution emanating from roadable oilfield hydraulic fracturing equipment, comprising:

a frame that is constructed and arranged for attachment to a chassis of roadable oilfield hydraulic fracturing equipment, the frame including a plurality of modular area subdivisions adapted for mounting a first set of sound damping panels according to claim 1;

each panel of the first set of sound damping panels having dimensions complementary to a corresponding one of the modular area subdivisions for attachment thereto;

at least one door configured to provide access to an interior space of the enclosure;

wherein the enclosure system is configured to enclose a portion of the roadable oilfield equipment, thereby decreasing the external noise output of the equipment.

6. The retrofit assembly of claim 5, wherein the roadable oilfield hydraulic fracturing equipment is a pumping unit, and the retrofit assembly encloses an engine and a radiator.

7. The retrofit assembly of claim 6, effective for reducing the normal operating C-weighted noise output of the pumping unit to a value of less than or equal to 90 dBC.

8. The retrofit assembly of claim 6, effective for reducing the normal operating A-weighted noise output of the piece of the pumping unit to less than or equal to 80 dBA.

9. The retrofit assembly of claim 5, wherein the radiator is formed as a plurality of radiator bodies that define an interior radiator space capped by a fan, and the radiator further comprises a second set of sound damping panels positioned in the interior radiator space.

10. The retrofit assembly of claim 9, wherein each of the second set of sound damping panels is constructed according to claim 1;

the second set of sound damping panels being deployed in the interior so as to disrupt a line of sight between the radiator bodies.

11. The retrofit assembly of claim 10, wherein the second set of sound damping panels each rise at an angle from a proximate radiator body towards the fan at a suitable angle for consequent reduction of fan horsepower as compared to horsepower requirements for equivalent movement of air if the first set of sound damping panels were not in place.

12. The retrofit assembly of claim 5 wherein the door is a reefer door.

13. The retrofit assembly of claim 5, further comprising a louvre permitting a flow of air into the enclosure, the louvre having slats oriented to direct sound emanating from within the enclosure downward towards the ground.

14. The retrofit assembly of claim 13, wherein the slats are coated with a polymer to facilitate the direction of sound.

15. The retrofit assembly of claim 14, further comprising a roof.

16. The retrofit assembly of claim 15, wherein the roof provides an opening for discharge of air through the fan.

17. The retrofit assembly of claim 5, wherein the roadable oilfield equipment is a hydration unit.

18. The retrofit assembly of claim 5, wherein the frame is coated with a sound reflective polymer.

19. In heavy equipment for use in oilfield hydraulic fracturing operations, the improvement comprising:

a sound-damping enclosure surrounding at least one of an engine, a pump and a radiator, the sound damping enclosure being constructed of a frame supporting a plurality of sound damping panels that are constructed according to claim 1.

20. A method of retrofitting roadable oilfield hydraulic fracturing equipment for noise mitigation, comprising:

attaching the retrofit assembly of claim 5 to a chassis of the roadable oilfield hydraulic fracturing equipment; and using the roadable oilfield hydraulic fracturing equipment in performance of a hydraulic fracturing operation.

* * * * *